United States Patent [19]

Compagnucci et al.

[11] Patent Number: 4,679,746

[45] Date of Patent: Jul. 14, 1987

[54] REEL TO WIND PACKAGES OF WIRE

[75] Inventors: Rossano Compagnucci, Osimo; Ercole Masera, Roveredo in Piano, both of Italy

[73] Assignees: Ferriere Nord SpA, Osoppo; Siro SpA, Santa Maria Nuova, both of Italy

[21] Appl. No.: 830,950

[22] Filed: Feb. 19, 1986

[30] Foreign Application Priority Data

Feb. 19, 1985 [IT] Italy ..... 83328 A/85

[51] Int. Cl.[4] ..... B65H 75/20

[52] U.S. Cl. ..... 242/77.2

[58] Field of Search ..... 242/77.2, 77, 129, 118.4, 242/118.7

[56] References Cited

U.S. PATENT DOCUMENTS

| | | | |
|---|---|---|---|
| 1,396,450 | 11/1921 | Martin | 242/77.2 |
| 1,850,265 | 3/1932 | German | 242/77.2 |
| 1,932,059 | 10/1933 | White | 242/77 |
| 1,972,723 | 9/1934 | White | 242/77 |
| 2,233,449 | 3/1941 | Glen | 242/115 |
| 2,566,867 | 9/1951 | Allen | 242/86 |
| 2,973,915 | 3/1961 | Elow | 242/77.2 |
| 3,977,622 | 8/1976 | Fecher | 242/77.2 |
| 4,032,078 | 6/1977 | Van de Loock | 242/77.2 |
| 4,089,485 | 5/1978 | Van de Loock | 242/77.2 |
| 4,570,871 | 2/1986 | Campagnucci | 242/77.2 |

FOREIGN PATENT DOCUMENTS

| | | |
|---|---|---|
| 0064894 | 11/1982 | European Pat. Off. . |
| 2272941 | 12/1975 | France . |
| 2299258 | 8/1976 | France . |
| 1009680 | 12/1976 | Italy . |
| 1049684 | 2/1981 | Italy . |

*Primary Examiner*—Stanley N. Gilreath
*Attorney, Agent, or Firm*—Wegner & Bretschneider

[57] ABSTRACT

Reel (10) to wind packages of wire, which reel comprises two heads (11–12) having a substantially circular periphery (17) and a central hub portion (18), each head (11–12) consisting of a plurality fo basic elements (14) having a U-shaped portion (15) provided with a first leg (115) and a second leg (215), such basic elements (14) comprising a circumferential portion (16), at least part of the periphery (17) of the heads (11–12) being formed by continuity of the circumferential portions (16) of the basic elements (14).

15 Claims, 6 Drawing Figures

REEL TO WIND PACKAGES OF WIRE

BACKGROUND OF THE INVENTION

This invention concerns a reel to wind packages of wire. To be more exact, the invention concerns a reel able to form coils of rod or wire and particularly, but not only, of welding wire.

The invention can also be employed for the winding of any filiform material or material which can be likened thereto, such as plastic hoses, electrical wire or other materials.

The invention can therefore be used to wind wires of various types in coils, such as metallic, plastic or coated wires or yet other types.

Different types of reels to wind wire are known. For instance, patent IT No. 1,049,684 in the name of STEIN is known and discloses the construction of a reel by welding together a given number of bent metallic rod elements. These elements are such that, when they have been united, they form a series of U-shaped spokes connected together by peripheral circumferential arcs.

The main shortcoming of this structure consists in the low rigidity of the whole. In fact, there are no cross members or other reinforcement elements to stiffen the structure axially or circumferentially.

A consequent drawback lies in the fact that the structure cannot take up the tension of the winding of material on it without excessive deformation when the reel has been detached from the removable flange portion with which the reel cooperates during the winding.

Another shortcoming consists in the easy deformation of the coils of wire wound on the reel when the reel is being handled, transported and used. Moreover, such reel requires an additional portion, such as an adapter, when it has to cooperate wiht the shaft of a winding machine or with an unwinding spindle.

In fact, the above reel for wire does not comprise in itself a hub or like means to perform such cooperation.

Another known embodiment is disclosed in patent IT No. 1,009,680, also in the name of STEIN. This patent discloses a reel consisting of two circular elements made of welded rod and joined together by U-shaped spokes which provide the support for the various coils.

This type of reel too has a low rigidity, mainly in the axial direction, owing to the low rigidity of the U-shaped spokes. Moreover, this reel, like the above cited IT No. 1,049,684, requires an adapter for use on a winding machine since in itself it lacks a hub or like means.

Patent FR No. 2,272,941 discloses an analogous reel for winding purposes.

U.S. Pat. No. 1,932,059 discloses a reel made of welded rod and consisting of two heads connected by cross rods on which the wire is wound. Each head consists of looped rods variously conformed and welded to each other, with or without an outer stiffening ring and possibly with a central core. Moreover, this embodiment includes a great number of parts, and the heads are not flat.

U.S. Pat. No. 2,233,449 discloses a knock-down reel of which the elements are assembled by insertion of lugs into openings; owing to its very nature this invention cannot ensure great rigidity; moreover, it is complex to construct owing to the presence of interlocking spokes.

U.S. Pat. No. 1,396,450 discloses a reel having a core formed of only three cross members, the winding therefore being prismatic and not circular; the structure is generally light and ill-suited for heavy winding duties, such as the winding of welding wire, for instance.

U.S. Pat. No. 2,566,867 discloses a light reel specifically intended for hoses for watering purposes and having side frames consisting of V-shaped elements welded at their ends to a stiffening ring, together with cross members to bear the wound hose.

U.S. Pat. No. 1,972,723 (WHITE) discloses reels having heads analogous to those of U.S. Pat. No. 1,932,059. The central core consists of a sheet or plate metal cylinder welded to the heads. This embodiment seems heavy and wasteful; moveover, it does not provide a reel consisting wholly of welded wire or rod.

U.S. Pat. No. 4,089,485 discloses another type of reel consisting of a set of elements formed as a sector of a cylinder, each element being a bent piece of wire. Each element comprises a cross member produced by bending and positioned axially to the reel.

Each element is obtained solely by bending a piece of wire and the various elements forming a sector of a cylinder are welded to each other to provide the whole reel.

As compared to the types cited above, this reel provides the great advantage of not requiring a central adapter for working with the shaft of a winding machine, such as a welding machine, for instance, which employs wire wound on a reel.

In fact, the conformation of the elements as cylindrical sectors is such that, when they have been welded together, they form a central hub of a substantially circular shape able to cooperate with the cited shaft.

However, this embodiment too entails various drawbacks, of which the first consists in the great quantity of metallic rod material required to construct such reel.

Moreover, the various elements are connected with spot welds which are not very strong and which do not contribute to the stiffening of the whole since the sections of the rods at the spot welds are slender.

Moreover, as the axial cross members on which the wire is wound are made with a bent segment of the elements forming the whole reel, such segment has a low rigidity as compared to the rigidity obtainable with welded cross members, for instance.

The whole reel, therefore, owing to its very nature does not possess enough rigidity and yet is heavy and is hard and burdensome to construct.

Another shortcoming of this embodiment lies in the fact that it is hard to connect the various elements forming the reel by welding and to maintain a correct coplanar positioning in correspondence with the circular heads of the reel which form the lateral flanges to hole the wound wire. In fact, neighboring elements often are staggered axially.

This means that, to obtain even winding, the radial elements of the reel have to be inserted more deeply in the corresponding hollows of the removable winding means.

As a result, when the completed package of wound wire has been withdrawn from such removable element, the coils tend to sag sideways against the heads of the reel in a very loose manner, and therefore the coils tend to become disarranged as they are not properly supported.

EP No. 0064894 and U.S. Pat. No. 1,850,265 disclose reels, of which the first is to hold welding wire and films, whereas the second is to hold films. Both of them provide a central element made of steel sheet, a plastic or another material and cooperating with radial elements, the whole assembly not offering the required flatness at its sides nor general solidity.

FR No. 2,299,258 discloses a reel made of elements extending in three dimensions from its center but not having a hub.

SUMMARY OF THE INVENTION

Our present invention has the purpose of obviating the shortcomings involved in the known art and cited above.

In particular, the reel of this invention forms an evolutive improvement of the reel described in U.S. Pat. No. 4,570,871. That cited patent discloses a reel formed with two heads of a circular shape joined together with welded metallic cross members. Each of such heads consists of a continuous circular element made of metallic rod and forming the periphery of the head. To such circumferential element are welded U-shaped spokes, which in turn are joined together at the middle of the head so as to form a hub portion to engage, for instance, the shaft of a winding machine.

The U-shaped elements are connected together in correspondence with such hub to form a three-dimensional structure, cooperation between neighbouring elements of the hub being such as to provide mutual superimposing of portion of such neighbouring elements.

The provision of such a three-dimensional structure at the hub and of welded connecting cross members imparts great strength to the reel disclosed in the above cited copending patent application;

A purpose of the present invention is to simplify the construction of a reel for packages of wire of a type described in a cited patent U.S. Pat. No. 4,570,871 and at the same time to keep unchanged or even to improve the quality of the strength and reliability of the reel described in that application.

The present invention arranges to provide heads for such reel which have a circular shape and include a smaller number of elements. In particular, the circular periphery of each head is no longer configured in this invention as an independent element. Insead, such circular periphery is obtained by the cooperation of a plurality of protrusions formed as an arc of a circle and jutting from the ends of the U-shaped elements which compose such heads of the reel.

In a preferred embodiment, for instance, each head of the reel for packages of wire consists of four such U-shaped elements. As a result, the circumferential periphery is formed by the cooperation of four arcs of a circle which are joined to each other consecutively when assembly has ended. The two heads of the reel are connected together by welded cross members.

In a preferred embodiment each of the elements forming a head comprises a U-shaped portion, which includes an arcuate segment that cooperates in providing the hub together with corresponding arcuate segments of the neighbouring elements of the same head.

A structure with a three-dimensional development is thus formed at the hub and imparts great rigidity to the reel.

According to the invention one of the legs of each element forming the head has at its end an extension having a circumferential development or protruding as an arc of a circle. The initial portion of such extension is bent inwards so as to cooperate with the end of the circumferential extension, or arc, of the immediately neighbouring element. In this way the extensions of neighbouring elements are positioned on the same circumference, one in prolongation of another.

Once more in a preferred embodiment, the leg of the U opposite to the leg having the circumferential extension has one end bent at a right angle. This end rests on the inside of, or at the side of (towards the exterior of the head), the circumferential arc consisting of the above extension attached integrally to and forming a prolongation of the other leg.

During assembly of the reel, this end bent at a right angle is welded to the circumferential extension and thus provides a substantially rigid element.

In an alternative embodiment this bent end can be fixed to the exterior of the periphery of the head in a direction axial to the reel and will thus be bent in a plane normal to that of the head and will be partly superimposed on the periphery of the head.

According to the invention, therefore, each of the elements forming the head includes one single length of bent metallic rod. Such rod with its various bends thus constitutes respectively the U-shaped portion of the inside of the head and, without continuous prolongation, the circumferential portion forming a part of the circular outer periphery of the head.

The present applicants have also determined, and made trials to show, that a more advanced and lighter type of reel can be provided which retains the same rigidity in full. According to such trials the reel is made as in the embodiment described above, but its outer circumference is no longer continuous and is made in segments extending along only a defined sector.

According to the concept of the present applicants the sectors of the circle can be produced with U-shaped elements or can be made by joining such U-shaped elements together laterally.

This invention is therefore embodied in a reel to wind packages of wire, which reel comprises two heads having a substantially circular periphery and a central hub portion and is characterized in that each head includes a plurality of basic elements having a U-shaped portion provided with a first leg and a second leg, such basic elements comprising a circumferential portion, at least part of the periphery of the heads being formed by the circumferential portions of the basic elements.

BRIEF DESCRIPTION OF THE DRAWINGS

We shall now describe a preferred embodiment of the invention as a non-restrictive example with the helf of the attached figures, in which.-

DETAILED DESCRIPTION

Figure 1:
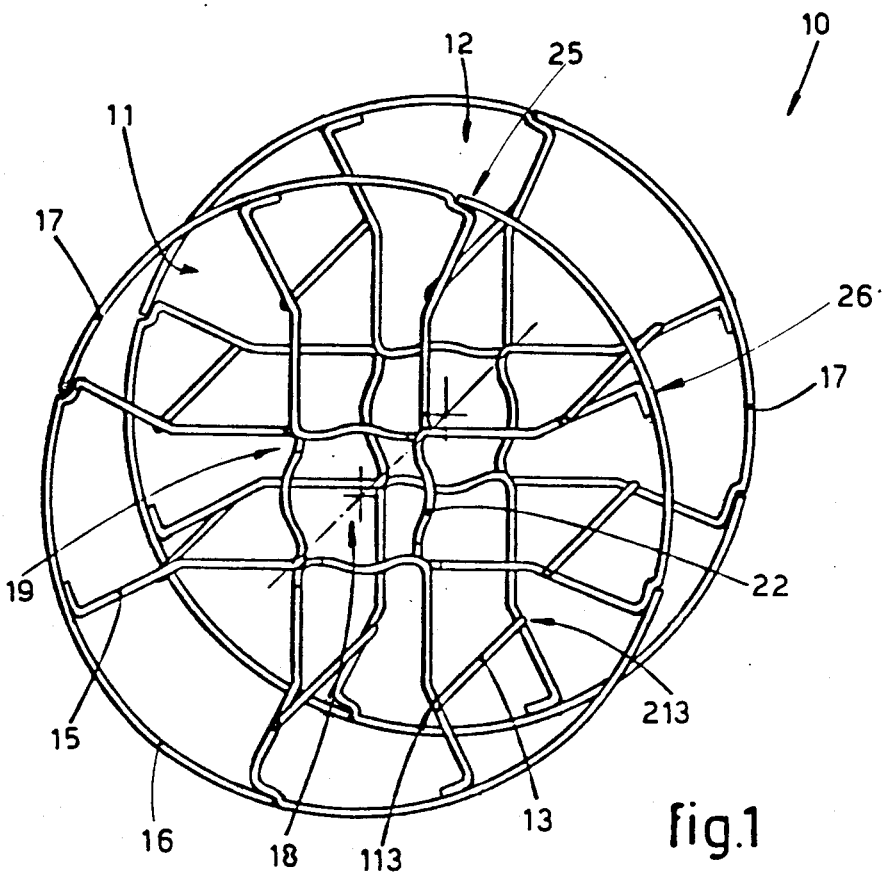
FIG. 1 is a three-dimensional view of the whole reel of the invention.

In FIG. 1, a reel 10 to wind packages of wire comprises two substantially circular heads 11–12 connected together by cross members 13, which are welded at their respective ends 113–213 to the heads 11–12 respectively so as to form a light but substantially rigid assemblage.

According to the invention each head 11–12 consists of basic elements 14 (see FIG. 2), each of which comprises a substantially U-shaped portion 15.

Such U-shaped portion 15 has two legs 115–215 connected together at their inner radial end by a curved segment 22. The segments 22 of the various elements 14, when assembled, form a hub 18 for cooperation, for instance, with the shaft of a winding machine. On each segment 22, each element 14 comprises an angular portion 20 bent axially to the reel 10 and also a normal angular portion 21 which is not so bent.

Figure 3:
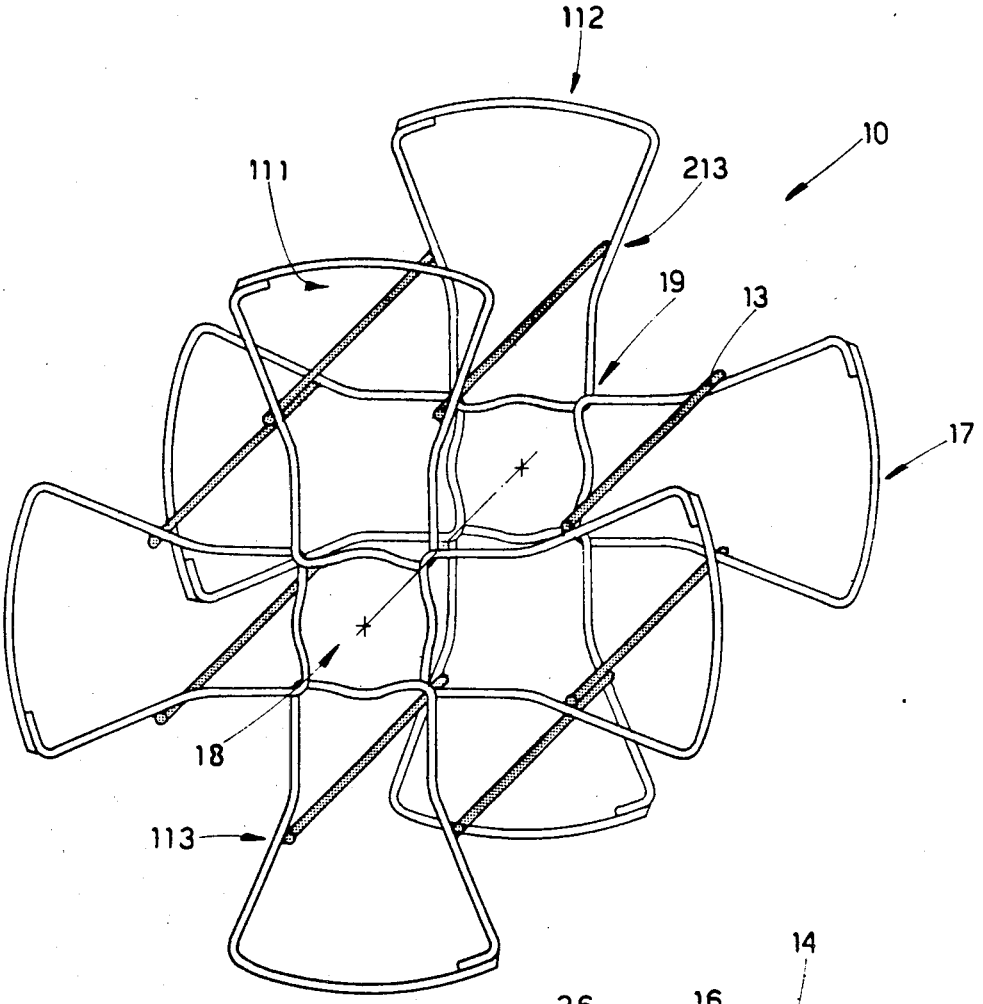
FIG. 3 shows an evolutive variant.
Figure 4:
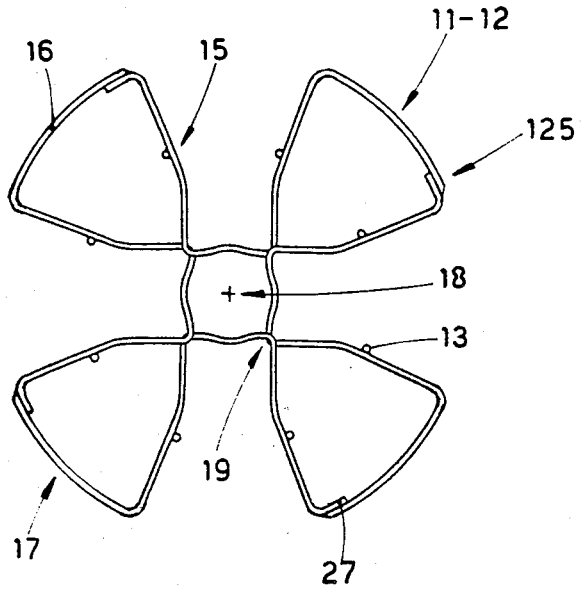
FIG. 4 shows another evolutive variant.

FIGS. 1, 3 and 4 show how the angular portion 21 of each element is superimposed against the axially bent angular portion 20 of the immediately neighbouring element 14, such portions 20–21 being joined by welding.

It is clear that in this way a structure is formed which has a substantially three-dimensional development is correspondence with its hub 18, and this imparts great strength to the reel 10. This special feature is described in the cited U.S. Pat. No. 4,570,871.

Figure 2:
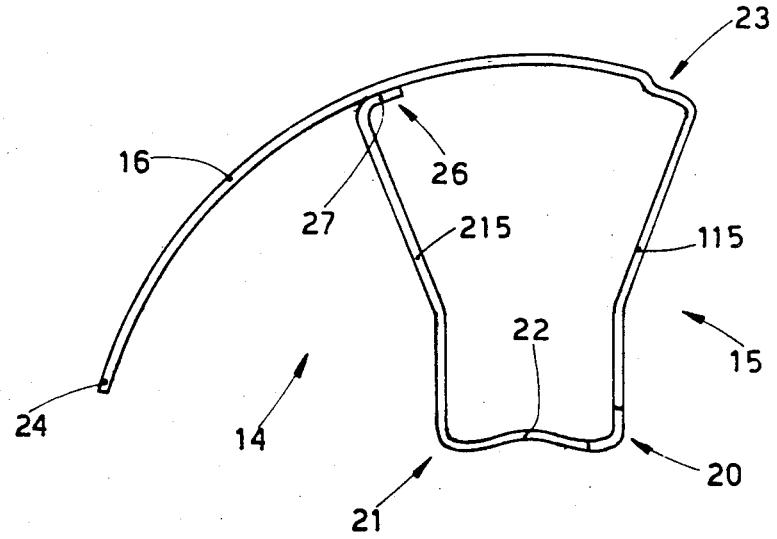
FIG. 2 shows one of the elements that form the heads.

A circumferential extension 16 is formed at the end of the leg 115 and in prolongation of the same. In the embodiment of FIG. 2 such circumferential extension extends beyond the leg 215, whereas in the embodiment of FIG. 5 it ends substantially in correspondence with the leg 215, and in the embodiments of FIGS. 4 and 6 it also ends at the leg 215 but at the leg of the neighboring element 15.

The initial part of such extension 16 in FIG. 2 comprises a bent seating 23, which is intended to lodge an end 24 of the immediately neighboring circumferential extension 16. Thus the end 24 of one extension 16 is welded at 25 (FIG. 1) to the bent seating 23 of the immediately neighboring element 15. The circumferential element 17 or circular periphery or profile of circular sectors (FIGS. 3 and 4) of the heads 11–12 is obtained in this way. Each of these circular elements 17, in this example, includes four extensions 16 of the basic elements 14.

The other leg 215 of the U-shaped element 15 comprises, in this case, a bent end 27, which is superimposed inside the extension 16 and is welded thereto (weld 26). A substantially rigid circular head is obtained in this way when welds 26 and 25 have been performed (see FIG. 1).

Figure 5:
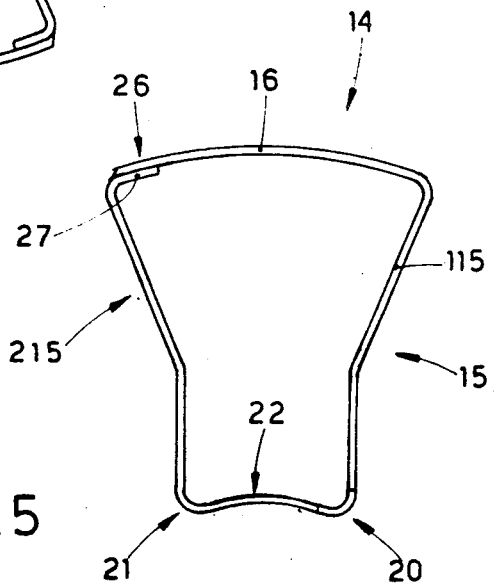
FIGS. 5 and 6 show an element which forms a head for the embodiments of FIG. 3 and FIG. 4 respectively.
Figure 6:
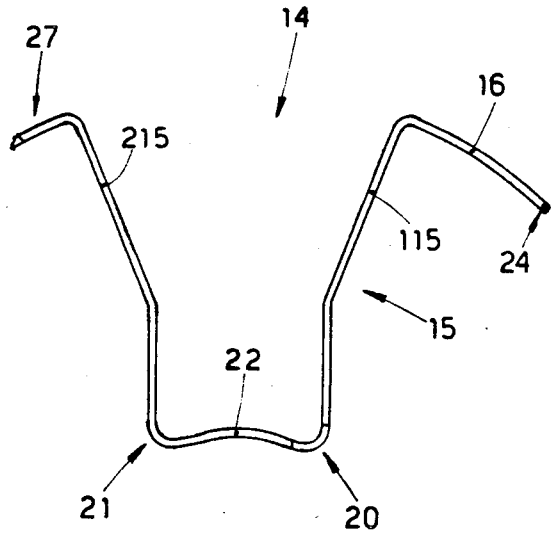

In the cases of FIGS. 3 and 5, on the other hand, a rigid head with the shape of a cross is obtained when the weld 26 has been performed. The position 23 and therefore the weld 25 are omitted in these cases.

In a variant which is not shown here, the bent end 27 could be superimposed on the side of the extension 16, advantageously on the outer side of the head 11 or 12 so as not to come in contact with the wire being wound.

In another variant, the bent end 27, instead of being bent in the same plane as the heads 11–12, could be bent in the opposite direction (FIG. 6) and would be superimposed, for instance, on the outside of the circular extension 16.

This embodiment can be employed in the case of FIGS. 1 and 2 or FIGS. 4 and 6. Thus, in the case of FIGS. 3 and 5 the extension 16 ends in correspondence with the leg 215 and is welded at 26 to the bent end 27, whereas in the case of FIGS. 4 and 6 the extension 16 is displaced sideways and ends in correspondence with the leg 215 of the preceding U-shaped element 15, being welded at 125 to the bent end 27 of such leg 215.

We have described here a preferred embodiment of the invention, but further variants are possible. For instance, the U-shaped portion 15 can be conformed in a manner other than that shown, for example with legs 115–215 consisting of one single straight segment, or curved, or bent in a different manner. The hub portion 18 can be structured differently from the example shown. A different number of cross members 13 can be provided, and any required plurality of elements 14 can be employed.

We claim:

1. A reel for winding coilable material comprising two opposed reel heads joined by cross members, each head comprising a plurality of bent filiform elements disposed essentially in a single plane, each element comprising:

(a) a substantially U-shaped member having a base and first and second legs, one of said legs forming a substantially planar angular portion with said base and the other leg forming an axially bent angular portion with said base; and (b) a substantially arcuate circumferential member extending from said first leg that incldues a seating means in the same plane as said circumferential member adjacent to said first leg;

the end of said circumferential member welded to the seating means of an adjacent circumferential member in the same reel head to form a substantially circular continuous periphery for said reel head, said planar angular portion being superposed on, and welded to, an adjacent axially bent angular portion in the same reel head to form a continuous hub for said reel head, the cross members being joined to legs of the opposed reel heads.

2. The reel of claim 1, wherein said second leg has an end portion bent at an angle to said second leg and welded to a circumferential member of the same reel head.

3. The reel of claim 2, wherein said end portion and said circumferential member in the same reel head occupy the same plane.

4. The reel of claim 2, wherein said circumferential member and the end portion of the second leg are oriented toward each other.

5. The reel of claim 2, wherein said circumferential member is welded to the end portion of the second leg of the same element.

6. The reel of claim 5, wherein said circumferential member and the end portion of the second leg are oriented toward the first leg of the same U-shaped member.

7. The reel of claim 6, wherein said circumferential member and the end portion of the second leg occupy the same plane.

8. A reel for winding coilable material comprising two opposed reel heads joined by cross members, each head comprising a plurality of bent filiform elements disposed in a single plane, and having a discontinuous periphery, each element comprising:

(a) a substantially U-shaped member having a base and first and second legs, one of said legs forming a substantially planar angular portion with said base and the other leg forming an axially bent angular portion with said base; and (b) a substantially arcuate circumferential member extending from said first leg; said circumferential member welded to a second leg in the same reel head to form the discontinuous periphery of said reel head, said planar angular portion superimposed on, and welded to, an adjacent axially bent angular portion in the same reel head to form a continuous hub of said reel head, and a plurality of cross members welded at their ends to substantially corresponding legs in opposed reel heads.

9. The reel of claim 8, wherein said second leg has an end portion bent at an angle to said second leg and welded to the end of a circumferential member in the same reel head.

10. The reel of claim 9, wherein said end portion and said circumferential member of the same reel head occupy the same plane.

11. The reel of claim 9, wherein said circumferential member and the end portion of the second leg are oriented toward each other.

12. The reel of claim 11, wherein the end of said circumferential member is welded to the end portion of a second leg of the same element.

13. The reel of claim 12, wherein said circumferential member and said end portion in the same element occupy the same plane.

14. The reel of claim 11, wherein the end of said circumferential member is welded to the end portion of the second leg of an adjacent element.

15. The reel of claim 14, wherein said circumferential member and said end portion in adjacent elements occupy the same plane.

* * * * *